US007452149B2

(12) United States Patent
Saito

(10) Patent No.: US 7,452,149 B2
(45) Date of Patent: Nov. 18, 2008

(54) ROTATING RETRACTABLE WRITING INSTRUMENT

(75) Inventor: Kouki Saito, Hiratsuka (JP)

(73) Assignee: Kabushiki Kaisha Pilot Corporation, Tokyo (JP)

( * ) Notice: Subject to any disclaimer, the term of this patent is extended or adjusted under 35 U.S.C. 154(b) by 340 days.

(21) Appl. No.: 10/589,510

(22) PCT Filed: Apr. 21, 2006

(86) PCT No.: PCT/JP2006/308428

§ 371 (c)(1),
(2), (4) Date: Aug. 15, 2006

(87) PCT Pub. No.: WO2007/010656

PCT Pub. Date: Jan. 25, 2007

(65) Prior Publication Data

US 2008/0226380 A1 Sep. 18, 2008

(30) Foreign Application Priority Data

Jul. 19, 2005 (JP) ..... 2005-208588

(51) Int. Cl.
*B43K 24/02* (2006.01)
*B43K 5/16* (2006.01)

(52) U.S. Cl. ..... 401/116; 401/109

(58) Field of Classification Search ..... 401/29–33, 401/99, 109–111, 116, 117
See application file for complete search history.

(56) References Cited

U.S. PATENT DOCUMENTS 4,786,197 A * 11/1988 Koeln et al. ..... 401/116
5,263,786 A * 11/1993 Kageyama ..... 401/111

FOREIGN PATENT DOCUMENTS

| | | |
|---|---|---|
| JP | 45/24978 | 9/1970 |
| JP | 63/87072 | 6/1988 |
| JP | 7/32133 | 7/1995 |

* cited by examiner

*Primary Examiner*—Tuan N Nguyen
(74) *Attorney, Agent, or Firm*—James Creighton Wray; Clifford D. Hyra

(57) ABSTRACT

The present invention relates to a rotating retractable writing instrument, which is constituted in a simpler way and can thrust a mouthpiece and a writing core element smoothly to positions ready for writing. The writing instrument by the present invention comprises a rear outer cylinder 2, an inner sheath 4 unrotatably accommodated in the rear outer cylinder 2, a front outer cylinder 10 from which a mouthpiece 12 and a writing core element 13 can be thrust. A protrusion 45 for restraining rotating range, a refill sliding cam 42 and a mouthpiece sliding cam 43 are formed in the inner sheath 4. A refill sliding element 6 and a mouthpiece sliding element 7 are accommodated in the inner sheath 4. The mouthpiece sliding element 7 is connected to the refill sliding element 6. Further a connecting element 9 is connected to the inner sheath 4. In the writing instrument constituted in the above-mentioned way, when the rear outer cylinder 2 is rotated in one direction relative to the connecting element 9, the mouthpiece and the writing core element are thrust out of an opening of the front outer cylinder 10. When the rear outer cylinder is further rotated, a tip of the writing core element is thrust out of an opening on a front face of the mouthpiece.

5 Claims, 18 Drawing Sheets

A-A

B-B

C-C

A-A

ROTATING RETRACTABLE WRITING INSTRUMENT

This application claims the benefit of Japanese Application No. 2005-208588 filed Jul. 19, 2005 and PCT/JP2006/308428 filed Apr. 21, 2006, which are hereby incorporated by reference in their entirety.

FIELD OF INVENTION

The present invention relates to a writing instrument, particularly relates to a rotating retractable writing instrument which can thrust a mouthpiece and a writing core element to positions ready for writing.

RELATED BACKGROUND ARTS

So-called rotating retractable typed writing instrument comprising a rear outer cylinder and a front outer cylinder has been known. When the two cylinders are relatively rotated each other, a writing core element of the writing instrument can be thrust out of the main body of the writing instrument.

Since the writing core element of such writing instrument can be held in the main body when the writing instrument is not in use, the writing instrument can be accommodated in a suit pocked or the like for carrying without contaminating the suit with ink.

In such writing instrument, although the writing core element can be held in the main body, a mouthpiece of the writing instrument is not held in the main body. Consequently, there is a possibility that the mouthpiece might scratch the suit with its sharp tip. Also there is another possibility that the mouthpiece sticks into and hurts a human body, when the mouthpiece is pressed by an external force. There is a further possibility that the mouthpiece is deformed by an external impact.

In order to avoid the above-mentioned possibilities, a rotating retractable writing instrument which can held the mouthpiece as well as the writing core element in the main body is proposed (see, for example, Japanese utility model laid open No. 7-32133). The writing instrument is arranged such that when the rear outer cylinder is kept being rotated in one direction relatively to the front outer cylinder, at first the mouthpiece is protruded from the main body and then the writing core is protruded from the mouthpiece by a further rotation. And the rear outer cylinder is kept being rotated in the reverse direction, at first the writing core element is held in the mouthpiece and then the mouth piece is held in the main body by a further rotation.

DISCLOSURE OF THE INVENTION

Problems to be Solved by the Invention

The above-mentioned example of the writing instruments is constituted as follows.

In a state where the mouthpiece is moved backward from an opening of the front outer cylinder and the writing core element is moved backward from an opening of the mouthpiece, when the rear outer cylinder is rotated in one direction relatively to the front outer cylinder, a protrusion on an outer face of an inner sleeve unit is moved forward along a screw groove formed on an inner face of a thrusting pipe which constitutes an intermediate sleeve unit, and as a result the mouthpiece is protruded from the main body.

In a state where the mouthpiece is protruded, the protrusion of the inner sleeve unit is at a pushed-out position from the front end of the screw groove. Just before the mouthpiece is protruded from the main body, a protrusion of a connecting element is fitted to the most rear end of the screw groove on the inner face of the thrusting pipe. When the rear outer cylinder is further rotated, the protrusion of the connecting element is moved forward along the screw groove so that the writing core element is protruded from the mouthpiece.

In the conventional writing instrument explained above, in a state where the protrusion of the inner sleeve unit is pushed out of the screw groove, but before the protrusion of the connecting element is connected to the screw groove, a position of the inner sleeve unit in the intermediate sleeve unit and a position of the connecting element in an axial direction of the main body are restrained by a compressed coil spring for pressing the protrusion of the inner sleeve unit backward and by a compressed coil spring for pressing the connecting element backward.

Consequently, in order to carry out two steps smoothly such that a proceeding step for pushing out the protrusion of the inner sleeve unit from the front end of the screw groove is smoothly led to a succeeding step for connecting the connecting element to the screw groove, there arises a problem to adjust a relative balance with good precision between the compressed coil spring for pressing the protrusion of the inner sleeve unit and the compressed coil spring for pressing the connecting element.

Sometimes the relative balance between the two coil springs is changed when the writing instrument is successively used, so that there is another problem that the mouthpiece and the writing core element cannot be thrust to positions ready for writing.

The present invention is carried out in view of the above-mentioned problems in order to provide a rotating retractable writing instrument, which is constituted in a simpler way and can thrust a mouthpiece and a writing core element smoothly to positions ready for writing.

Means to Solve the Problems

The above-mentioned objective by the present invention is attained by the following technical arrangements.

(1) A rotating retractable writing instrument comprising: a rear outer cylinder with an open front face; an inner sheath unrotatably accommodated in the rear outer cylinder; and a front outer cylinder with open faces on both ends, wherein: a mouthpiece and a writing core element can be thrust out of an opening formed on the front face of the front outer cylinder, the writing instrument further comprising: a protrusion for restraining rotating range arranged on a front end face of the inner sheath; and a refill sliding cam and a mouthpiece sliding cam formed on an inner face of the inner sheath, the writing instrument further comprising: a refill sliding element and a mouthpiece sliding element accommodated in the inner sheath slidably in an axial direction and unmovably in a radial direction; and protruded portions for sliding formed respectively on outer faces of the refill sliding element and the mouthpiece sliding element; wherein: the protruded portions for sliding are respectively fitted to the refill sliding cam and the mouthpiece sliding cam; and the mouthpiece sliding element is slidably and unrotatably connected to the refill sliding element, the writing instrument further comprising: a connecting element connected to the inner sheath rotatably and unmovably in the axial direction; and a rotating position restraining member arranged on an outer face of the connecting element for restraining a rotation of the inner sheath; wherein: the mouthpiece sliding element is slidably fitted to the connecting element, wherein: when the rear outer cylinder is rotated in one direction relative to the connecting element, the inner sheath is rotated in the same direction together with the rear outer cylinder so that the mouthpiece and the writing core element are propelled forward and thrust out of the opening of the front outer cylinder; and when the rear outer cylinder is further rotated in the same direction, the writing core element is propelled forward and thrust out of an opening on the front face of the mouthpiece.

(2) The writing instrument according to (1), wherein: the writing instrument further comprises a connecting member; a flange shaped portion with a large diameter is arranged in the middle of the connecting screw; a rear end face of the flange shaped portion is slidingly fitted to the front face of the rear outer cylinder; the front outer cylinder is detachably connected to the connecting member; and the connecting member is detachably connected to the connecting element.

(3) The writing instrument according to (1) or (2), wherein: in a first range starting from an arbitrary line in an axial direction on the inner face of the inner sheath, the refill sliding cam and the mouthpiece sliding cam respectively have first slopes; in a second range succeeding to the first range, the refill sliding cam has a perpendicular portion and the mouthpiece sliding cam has a sliding element fitting recess; in the next third range, the refill sliding cam has a second slope and the mouthpiece sliding cam has a perpendicular portion; in the next fourth range, the refill sliding cam has a sliding element fitting recess; and in the next fifth range, the refill sliding cam and the mouthpiece sliding cam respectively have protrusions for restraining rotation.

(4) The writing instrument according to any one of (1) to (3), wherein: a resistant member is arranged on an outer face of the connecting element such that the resistant member is slidingly contacted to the rear outer cylinder.

(5) The writing instrument according to (4), wherein: the resistant member is an O-ring.

Effects Attained by the Invention

The present invention can provide the rotating retractable writing instrument, which can be constituted in the simpler way and can thrust the mouthpiece and the writing core element smoothly to positions ready for writing.

EXPLANATION OF REFERENCE CHARACTERS

Figure 1:
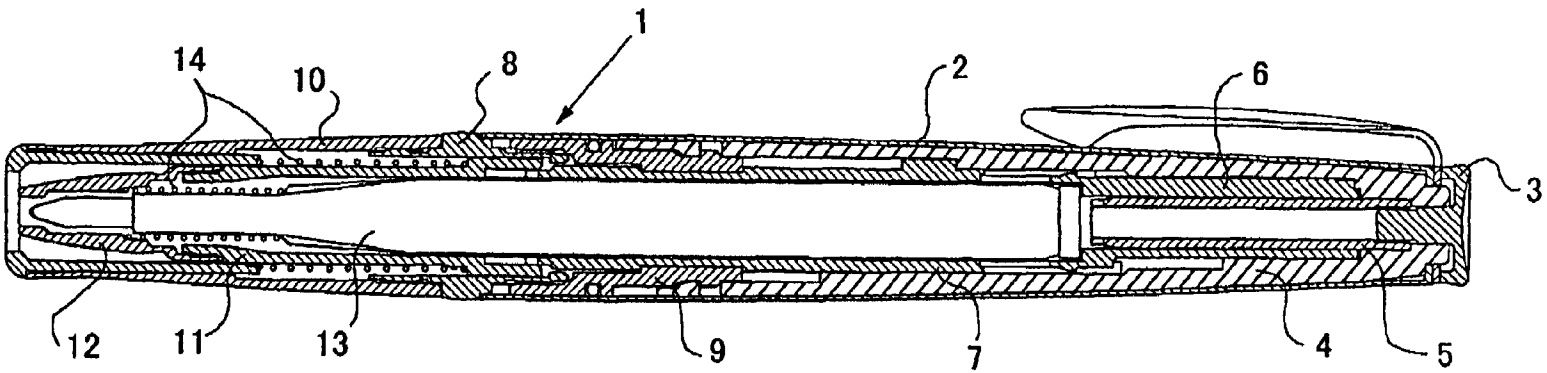
FIG. 1 is an outline cross-sectional view illustrating an assembled state by the whole parts of the writing instrument.

1 writing instrument
2 rear outer cylinder
4 inner sheath
6 refill sliding element
7 mouthpiece sliding element
8 connecting screw
9 connecting element
10 front outer cylinder
11 inner cylinder
12 mouthpiece
13 writing core element
42 refill sliding cam
43 mouthpiece sliding cam
45 protrusion for restraining rotating range

PREFERRED EMBODIMENT BY THE PRESENT INVENTION

The preferred embodiment by the present invention is explained as referring to drawings.

Dimensions, materials, shapes and mutual arrangements of components are not limited to descriptions in the present specification, unless they are particularly specified in the specification.

Embodiment 1

FIG. 1 is the outline cross-sectional view illustrating the assembled state by the whole parts of the rotating retractable writing instrument. As shown in FIG. 1, a writing instrument 1 comprises a rear outer cylinder 2, a head screw 3 detachably attached to the rear outer cylinder 2, an inner sheath 4 held in the rear outer cylinder 2, a nut 5 held in the inner sheath 4, a refill sliding element 6 and a mouthpiece sliding element 7 slidably held in the inner sheath 4, a connecting screw 8 as a connecting part slidably contacted to the rear outer cylinder 2, a connecting element 9 detachably attached to the connecting screw 8, a front outer cylinder 10 constituted by two parts detachably attached to the connecting screw 8, an inner cylinder 11 slidably held in the front outer cylinder 10, a mouthpiece 12 attached to the inner cylinder 11, a writing core element 13 held in the inner cylinder 11 and in the mouthpiece sliding element 7 and return springs 14 arranged between the front outer cylinder 10 and the inner cylinder 11, and between the writing core element 13 and the mouthpiece 12.

Figure 2:
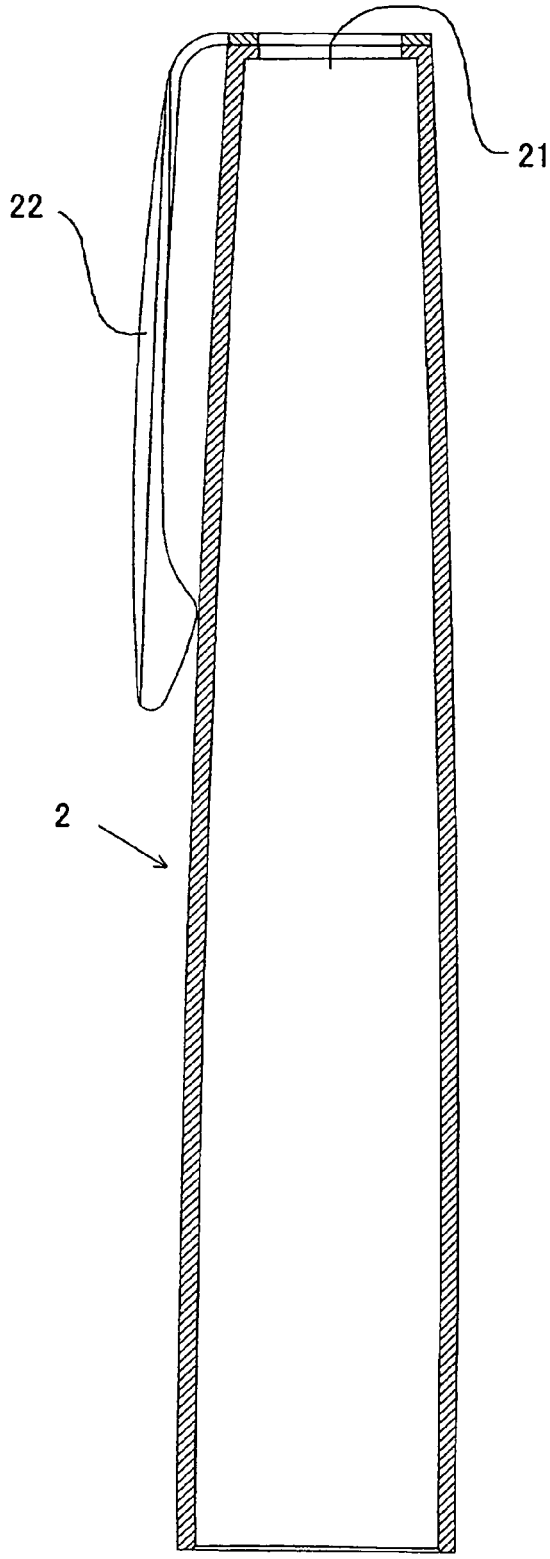
FIG. 2 is an outline cross-sectional view illustrating the rear outer cylinder.

FIG. 2 is the outline cross-sectional view illustrating the rear outer cylinder 2. As shown in FIG. 2, the rear outer cylinder is a cylindrical member with open faces on both ends and an opening 21 is formed on its rear end face. A protruded portion of the head screw 3 (which is explained below) is inserted into the opening 21 on the rear end face, and a rim on a back face of the head screw 3 is slidingly contacted to a rim on the rear end face of the rear outer cylinder 2. An arrangement without the head screw 3 is also possible, but the opening should not be formed on the rear end face of the rear outer cylinder 2.

A clip 22, which has been well known, may be detachably attached to the rear end or an outer side face of the rear outer cylinder 2. In FIG. 2, the clip 22 is attached to the rear end of the rear outer cylinder 2. In this arrangement, a circular end of the clip 22 is held between the rear end of the rear outer cylinder 2 and the rim on the back face of the head screw 3.

An inner face of the rear outer cylinder 2 is fitted to an outer face of the inner sheath 4. The front end face of the rear outer cylinder 2 is slidingly contacted to a rear end face of a large diameter portion of the connecting screw 8 (which will be explained below). The front end portion of the rear outer cylinder 2 is slidingly contacted to an outer side face of the connecting element 9 (which will be explained below) such that the rear outer cylinder 2 and the inner sheath 4 can be rotated relatively to the connecting element 9.

Figure 3:
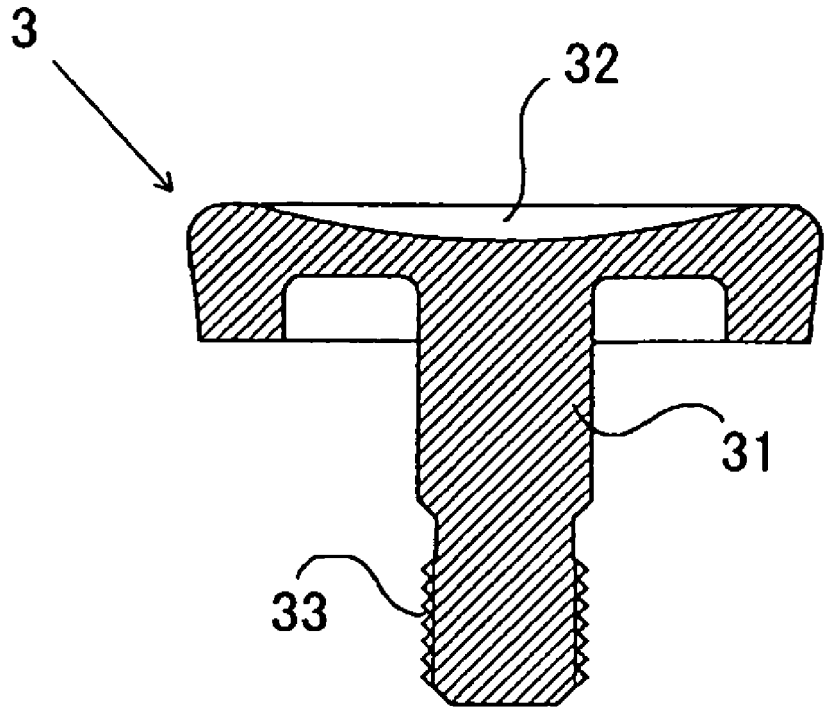
FIG. 3 is an outline cross-sectional view illustrating a head screw.

FIG. 3 is the outline cross-sectional view illustrating the head screw 3. As shown in FIG. 3, the head screw 3 has a protruded portion 31 so that the head screw 3 shows a T-shaped cross section. The protruded portion 31 is inserted into an opening on the rear end face of the inner sheath 4 (which will be explained below). A screw groove 33 is formed around on the outer face at the end of the protruded portion 31 so as to be screwed in a screw groove formed around in the inner face at the rear end of a nut 5 (which will be explained below).

Engraved or holographic patterns may be formed on a surface 32 of the head screw 3. The surface 32 may be covered with a resin coating. A protrusion having a hole for screwing a string may be formed on the surface 32.

Figure 4A:
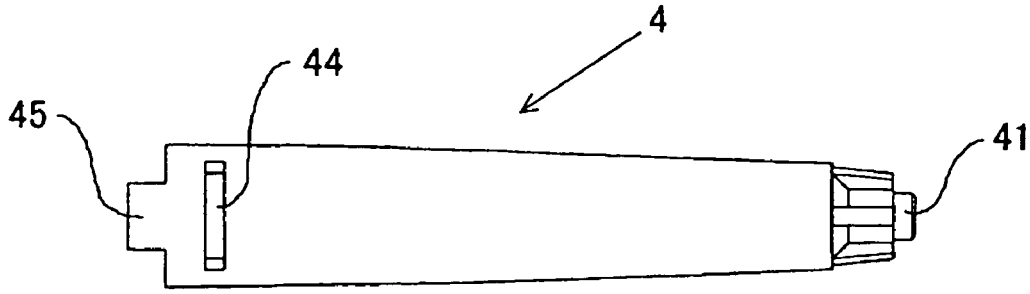
FIGS. 4A and 4B are views illustrating a structure of an inner sheath.
Figure 4B:
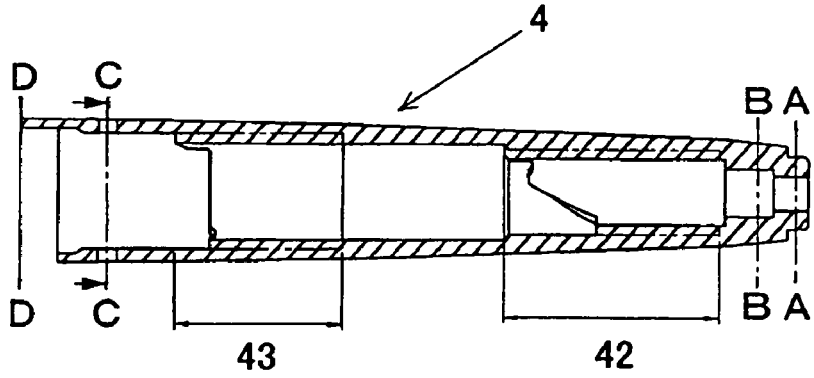
Figure 5A:
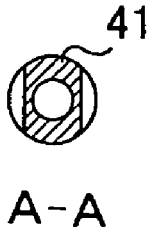
FIGS. 5A to 5D are cross-sectional views illustrating different portions of the inner sheath.
Figure 5B:
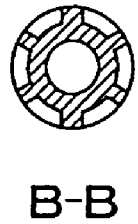
Figure 5C:
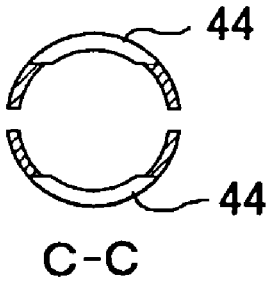
Figure 5D:
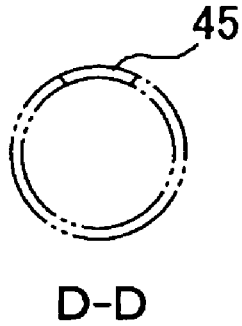

FIGS. 4A and 4B are views illustrating the structure of the inner sheath 4. FIG. 4A is a plan view and FIG. 4B is a cross-sectional view cut along a center line of FIG. 4A. FIGS. 5A to 5D are cross-sectional views of the inner sheath 4. FIG. 5A is a cross-sectional view cut along line A-A in FIG. 4B. FIG. 5B is a cross-sectional view cut along line B-B in FIG. 4B. FIG. 5C is a cross-sectional view cut along line C-C in FIG. 4B. FIG. 5D is a cross-sectional view cut along line D-D in FIG. 4B.

As shown in FIG. 4B, the inner sheath 4 is a cylindrical body with open faces on both ends. As shown in FIG. 4A and FIG. 5A, a rear end portion 41 is formed at one end of the sheath 4. A cross-section of the rear end portion 41 shows an annular ring shape partially cut by two parallel planes. As shown in FIG. 1, the rear end portion 41 is protruded from the opening 21 of the rear outer cylinder 2 and the outer side face of the rear outer cylinder 2 is abrasively fitted to or adhesively fixed to the inner face of the rear end portion 41. As a result the inner sheath 4 unrotatably fitted to the rear outer cylinder 2.

As shown in FIG. 4A and FIG. 5B, straight grooves are formed on a rear portion of the sheath 4 in the axial direction.

The protruded portion 31 of the head screw 3 is inserted in an opening of the rear end portion 41 which is protruded from the opening 21 of the rear outer cylinder 2, and the inner side face of the rear end portion 41 and a base portion of the protruded portion 31 are abrasively fitted each other. And a tip of the protruded portion 31 passes through the rear end portion 41 of the inner sheath 4.

As shown in FIG. 4A and FIG. 5C, slits 44 are formed on a front portion of the sheath 4. Protruded portions formed on a rear outer face of the connecting element 9 (which will be explained below) are held in the slits 44. As shown in FIG. 4A and FIG. 5D, a protrusion 45 for restraining rotating range is formed at a front end of the sheath 4.

A refill sliding cam 42 is formed on the rear end portion of an inner face of the sheath 4 and a mouthpiece sliding cam 43 is formed on the front end portion of the inner face of the sheath 4.

Figure 6:
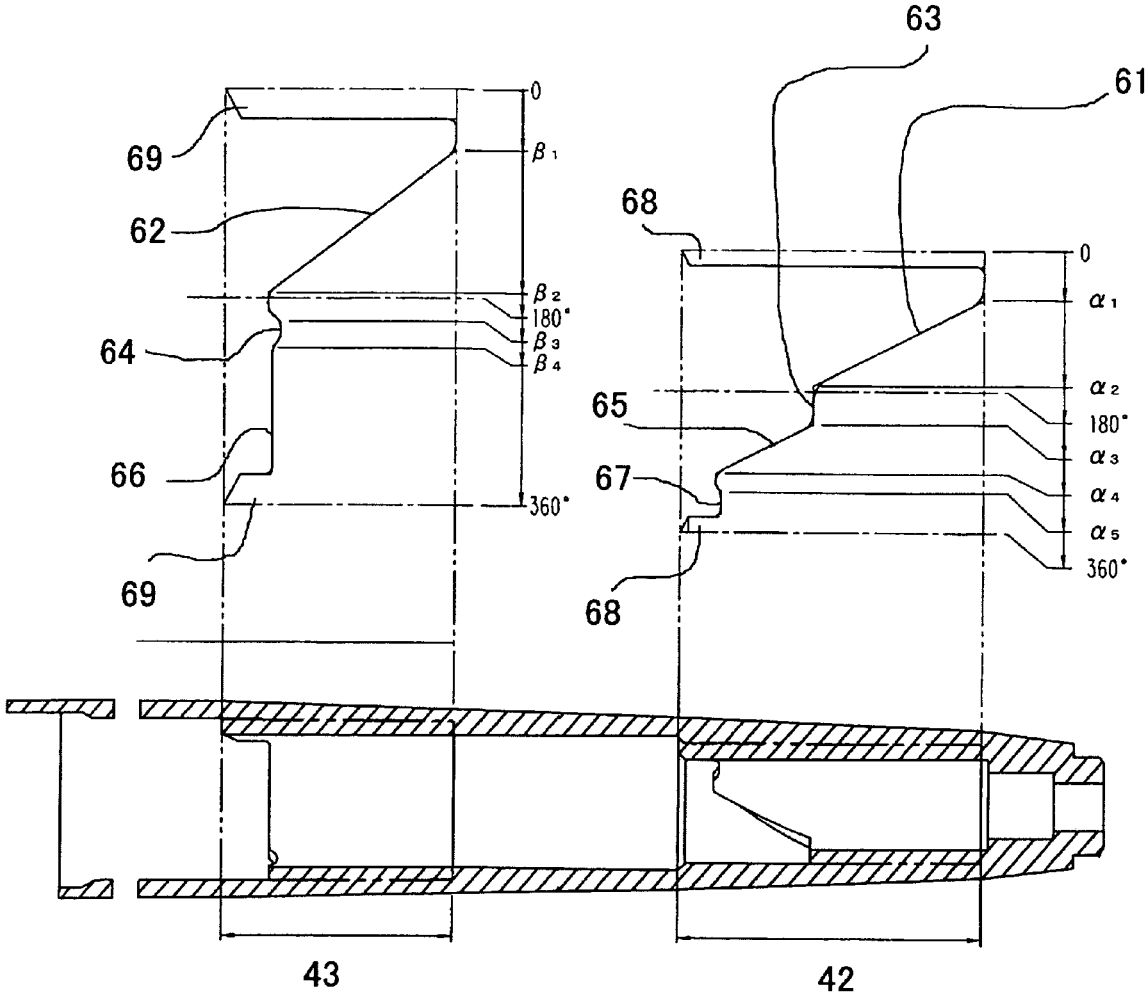
FIG. 6 is developed views of a refill sliding cam and a mouthpiece sliding cam.

The refill sliding cam 42 and the mouthpiece sliding cam 43 will be explained in detail below. FIG. 6 is developed diagrams of the refill sliding cam 42 and the mouthpiece sliding cam 43 formed on the inner face of the sheath 4.

Starting from an arbitrary point in a range from 0° to 180° the refill sliding cam 42 and the mouthpiece sliding cam 43 respectively have first slopes 61, 62 with arbitrary inclinations in the axial direction of the sheath 4. Heights of the both slopes in the axial direction are nearly the same.

The refill sliding cam 42 has a perpendicular portion 63 to the axial direction starting from $\alpha_2$ near 180° to $\alpha_3$. The mouthpiece sliding cam 43 has a sliding member fitting recess 64 in a range from $\beta_3$ to $\beta_4$. The refill sliding cam 42 also has a slope 65 with an arbitrary inclination in the axial direction in a range from $\alpha_3$ to $\alpha_4$. The mouthpiece sliding cam 43 has a perpendicular portion 66 to the axial direction at position $\beta_4$. The refill sliding cam 42 has a sliding member fitting recess 67 at a position $\alpha_5$. Both refill sliding cam 42 and mouthpiece sliding cam 43 respectively have protrusions 68, 69 for restraining rotation near 360°. Relations among angles $\alpha$ and $\beta$ are as follows.

$$0<\beta_1<\alpha_1<\alpha_2<\beta_2<180^\circ<\beta_3<\alpha_3<\beta_4<\alpha_4<\alpha_5<360^\circ$$

Figure 7:
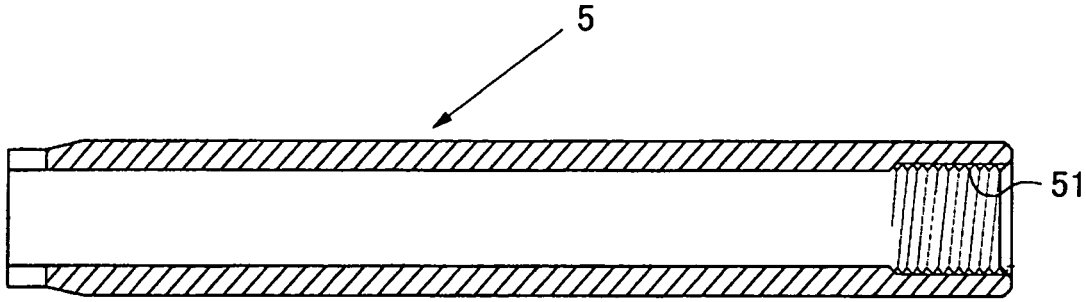
FIG. 7 is an outline cross-sectional view of a nut.

FIG. 7 is the outline cross-sectional view of the nut 5. As shown in FIG. 7 the nut 5 is a cylindrical body with open faces on both ends.

A screw groove 51 is formed around an inner face of its rear end. The tip of the protruded portion 31 of the head screw 3 passes through the rear end portion 41 of the inner sheath 4 and the screw groove 33 of the protruded portion 31 is screwed in the screw groove 51 of the nut 5 as the protruded portion 31 being inserted in the rear end portion 41 of the inner sheath 4. As a result, the nut 5 is detachably connected to the head screw 3 so that the rear outer cylinder 2 and the inner sheath 4 are held by the nut 5 and the head screw 3. In a state where the screw groove 33 of the head screw 3 and the screw groove 51 of the nut 5 are connected each other, the nut 5 and the head screw 3 cannot relatively be moved each other. But when the connection between the screw groove 33 and the screw groove 51 is loosened, the nut 5 and the head screw 3 can be relatively rotated each other.

A rear portion of an outer face of the nut 5 is slidingly fitted to the inner face of the sheath 4. A diameter of the outer face of the nut 5 is nearly the same as a diameter of the inner face of the refill sliding element 6 (which will be explained below), so that the nut 5 is slidingly fitted to the inner face of the refill sliding element 6.

In the present embodiment, the nut 5 is formed as a separate part from the sheath 4, but it is not limited to this arrangement. For example, the nut 5 may be integrated with the sheath 4.

Figure 8F:
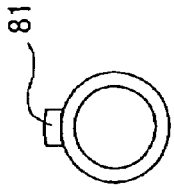
FIGS. 8A to 8F are views illustrating a refill sliding element.
Figure 8A:
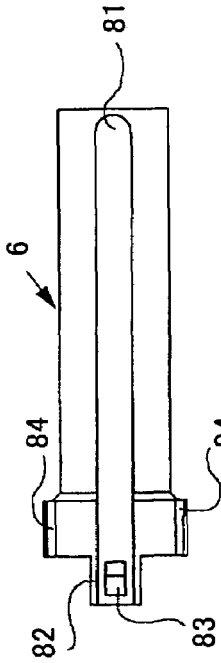
Figure 8B:
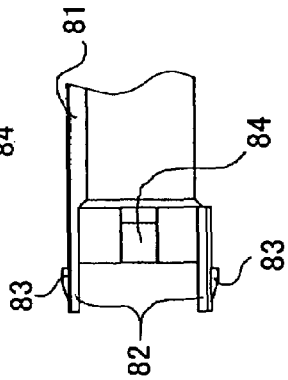
Figure 8C:
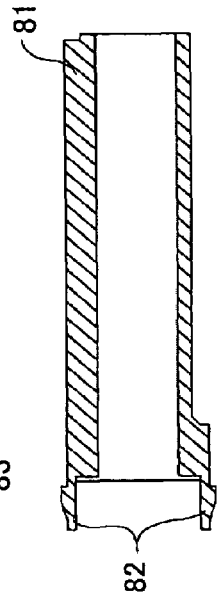
Figure 8D:
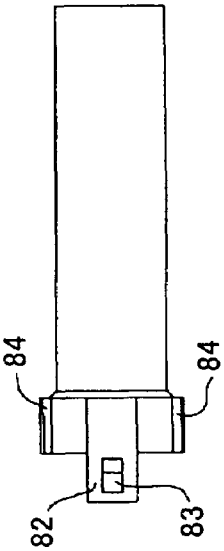
Figure 8E:
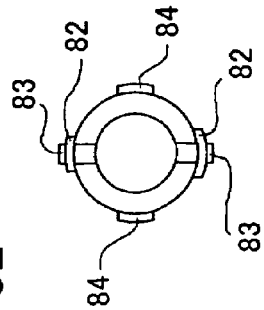

FIGS. 8A to 8F are views illustrating the refill sliding element 6. FIG. 8A is a plan view, FIG. 8B is a partial front view of FIG. 8A, FIG. 8C is a front cross-sectional view of FIG. 8A, FIG. 8D is a bottom view, and FIGS. 8E and 8F are left and side views of the refill sliding element 6.

As shown in FIG. 8C, the refill sliding element 6 is a cylindrical body with open faces on both ends. The rear end face of the refill sliding element 6 is fitted to the inner sheath 4. An inner face of the refill sliding element 6 is slidingly fitted to the outer face of the nut 5 and an outer face of the refill sliding element 6 is slidingly fitted to the inner face of the inner sheath 4, so that the refill sliding element 6 is held by the inner sheath 4 and the nut 5 slidably in the axial direction but unmovably in the radial direction. The rear outer cylinder 2, the inner sheath 4 and the nut 5 are rotatable relative to the refill sliding element 6.

A protruded portion 81 for sliding is formed on the outer face of the refill sliding element 6 in the axial direction. The protruded portion 81 for sliding is fitted to the refill sliding cam 42 of the inner sheath 4. On the front end face of the refill sliding element 6, protrusions 82 for fitting are protruded in the axial direction. Protruded portions 83 for fitting are formed on the outer face of the respective protrusions 82 for fitting. The protrusions 82 for fitting and protruded portions 83 for fitting are held in slits formed on a rear portion of the mouthpiece sliding element 7 (which will be explained below).

Protruded portions 84 for restraining are formed on the front outer face of the refill sliding element 6 for fitting to recesses formed in the rear portion of the mouthpiece sliding element 7.

Figure 9A:
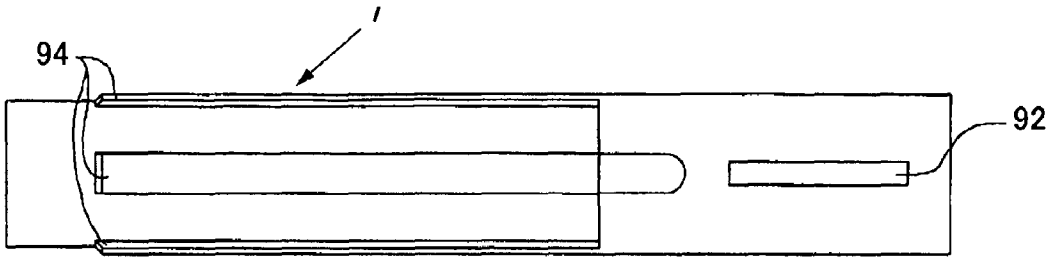
FIGS. 9A to 9D are views illustrating a mouthpiece sliding element.
Figure 9B:
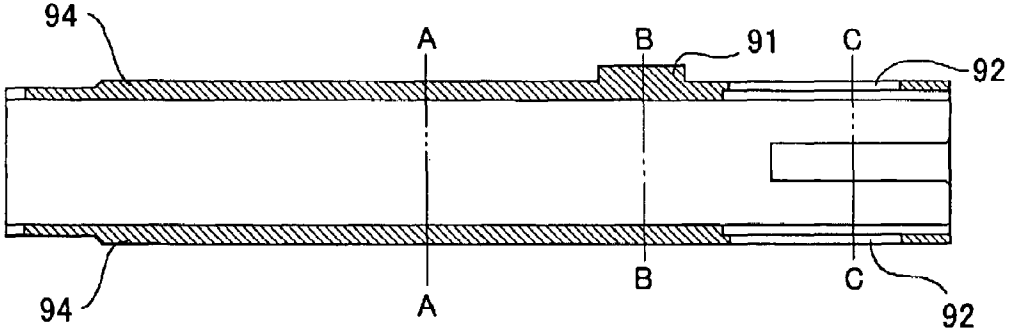
Figure 9C:
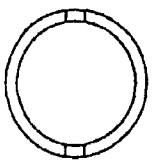
Figure 9D:
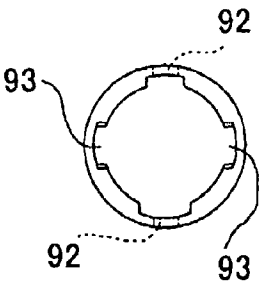
Figure 10A:
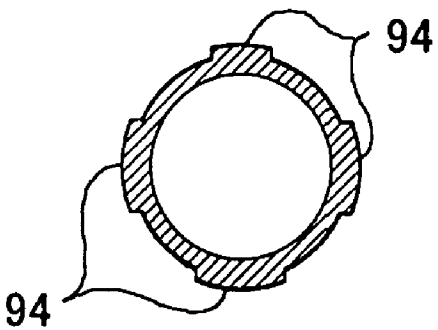
FIGS. 10A to 10C are cross-sectional views illustrating different portions of the mouthpiece sliding element.
Figure 10B:
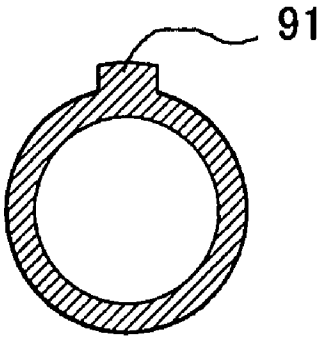
Figure 10C:
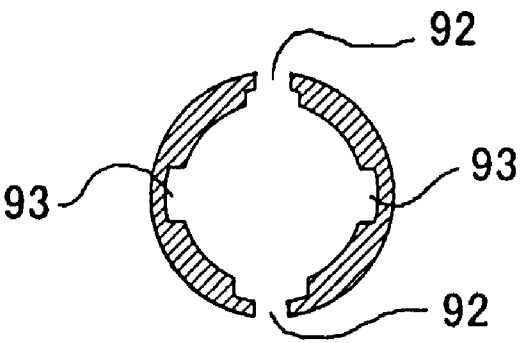

FIGS. 9A to 9D are views illustrating the mouthpiece sliding element 7. FIG. 9A is a plan view, FIG. 9B is a front cross-sectional view and FIGS. 9C, 9D are respectively a left side view and a right side view. FIGS. 10A to 10C are cross-sectional views illustrating different portions of the mouthpiece sliding element in FIGS. 9A to 9D. FIG. 10A is a cross-sectional view cut along line A-A in FIG. 9B, FIG. 10B is a cross-sectional view cut along line B-B in FIG. 9B and FIG. 10C is a cross-sectional view cut along line C-C in FIG. 9B.

As shown in FIG. 9B, the mouthpiece sliding element 7 is a cylindrical body with open faces on both ends. As clearly shown in FIG. 10B, a protruded portion 91 for sliding is formed on a rear portion of the mouthpiece sliding element 7. The protruded portion 91 for sliding is fitted to the mouthpiece sliding cam 43 formed in the inner sheath 4.

Slits 92 are formed on the rear portion of the mouthpiece sliding element 7 in the axial direction. The slits 92 hold the protrusions 82 for fitting and protruded portions 83 for fitting of the refill sliding element 6. In this way, the refill sliding element 6 is slidingly but unrotatably connected to the mouthpiece sliding element 7.

Hollows 93 for restraining are formed on the rear inner face of the mouthpiece sliding element 7. The protruded portions 84 for restraining of the refill sliding element 6 are fitted to hollows 93 such that the refill sliding element 6 is slidingly but unrotatably connected to the mouthpiece sliding element 7.

Guides 94 are formed on the outer face of the mouthpiece sliding element 7 from a front face of the protruded portion 91 for sliding to near the front end of the mouthpiece sliding element 7. The guides 94 are held in guide rails formed on the rear inner face of the connecting element 9 (which will be explained later). The front end of the mouthpiece sliding element 7 fits a rear end face of the inner cylinder 11 (which will be explained later).

Figure 11A:
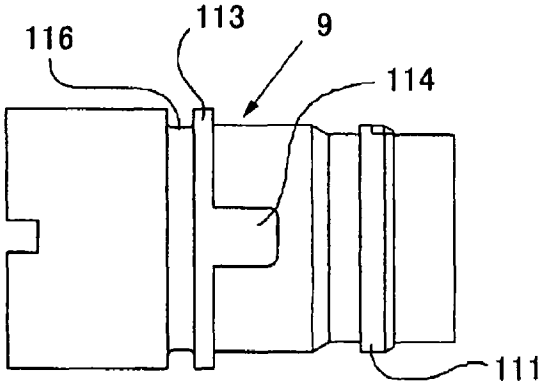
FIGS. 11A to 11E are views illustrating a connecting element.
Figure 11B:
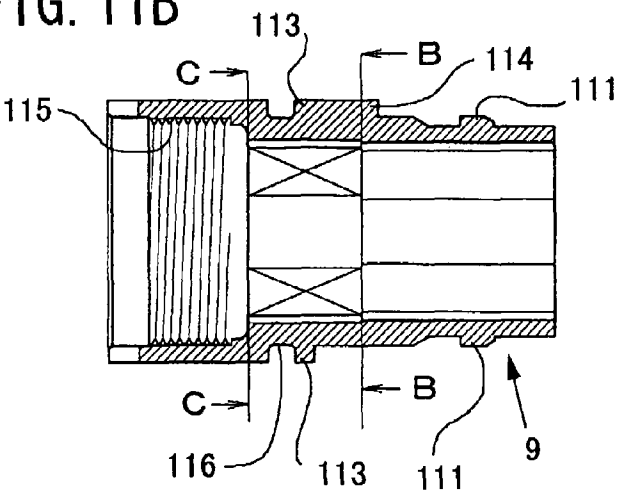
Figure 11C:
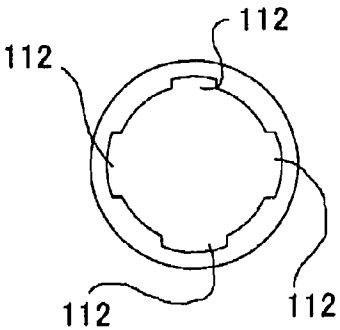
Figure 11D:
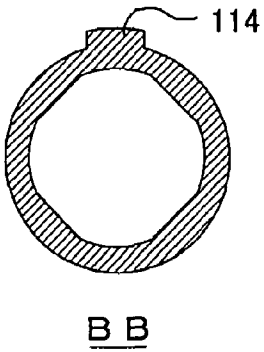
Figure 11E:
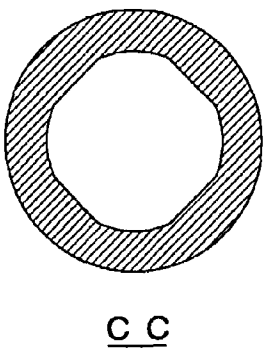

FIGS. 11A to 11E are views illustrating the connecting element 9. FIG. 11A is a plan view, FIG. 11B is a front cross-sectional view, FIG. 11C is a right side view of FIG. 11B, FIG. 11D is a cross-sectional view cut along line B-B in FIG. 11B and FIG. 11E is a cross-sectional view cut along line C-C in FIG. 11B.

As shown in FIG. 11B, the connecting element 9 is a cylindrical body with open faces on both ends. A protruded portion 111 is formed around on a rear outer face of the connecting element 9. The protruded portion 111 is held in the slits 44 of the inner sheath 4, so that the inner sheath 4 is rotatably but unmovably in the axial direction connected to the connecting element 9.

Guide rails 112 are formed on a rear inner face of the connecting element 9. The guides 94 formed on the outer face of the mouthpiece sliding element 7 are held in the guide rails 112 such that the mouthpiece sliding element 7 is slidably but unrotatably fitted to the connecting element 9. The outer face of the mouthpiece sliding element 7 is slidingly contacted to the inner face of the connecting element 9.

A flange shaped inner sheath fitting portion 113 is formed around in the middle of the outer face of the connecting element 9. The front end face of the protruded portion 45 for restraining rotating range formed on the inner sheath 4 is slidingly contacted to a rear face of the inner sheath fitting portion 113. A rotating position restraining member 114 is formed backward from the rear face of the inner sheath fitting portion 113. A screw groove 115 is formed around on a front inner face of the connecting element 9 so as to be screwed to a screw groove formed around a rear outer face of the connecting screw (which will be explained below).

The outer face of the connecting element 9 beginning from the rear face of the inner sheath fitting portion 113, is slidingly contacted to the inner face of the inner sheath 4 and the front outer face of the connecting element 9 is slidingly contacted to the inner face of the rear outer cylinder 2, so that the rear outer cylinder 2 and the inner sheath 4 are slidingly rotatable relative to the connecting element 9. A rotating range of the inner sheath 4 is restrained to a position where the protruded portion 45 for restraining rotating range is fitted to the rotating position restraining member 114.

An O-ring holding groove 116 is formed around on the outer face of the connecting element 9. A rubber O-ring as a resistant member is held in the O-ring holding groove 116 and the outer face of the O-ring is slidingly contacted to the inner face of the rear outer cylinder 2. Due to this arrangement, a friction force is generated between the outer face of the O-ring and the rear outer cylinder 2, so that appropriate resistance is added to the rotation of the inner sheath 4 and the rear outer cylinder 2.

The material for the O-ring is not limited to rubber, but any material which can generate appropriate resistance may be employed. The shape of the O-ring is not specifically limited.

Figure 12:
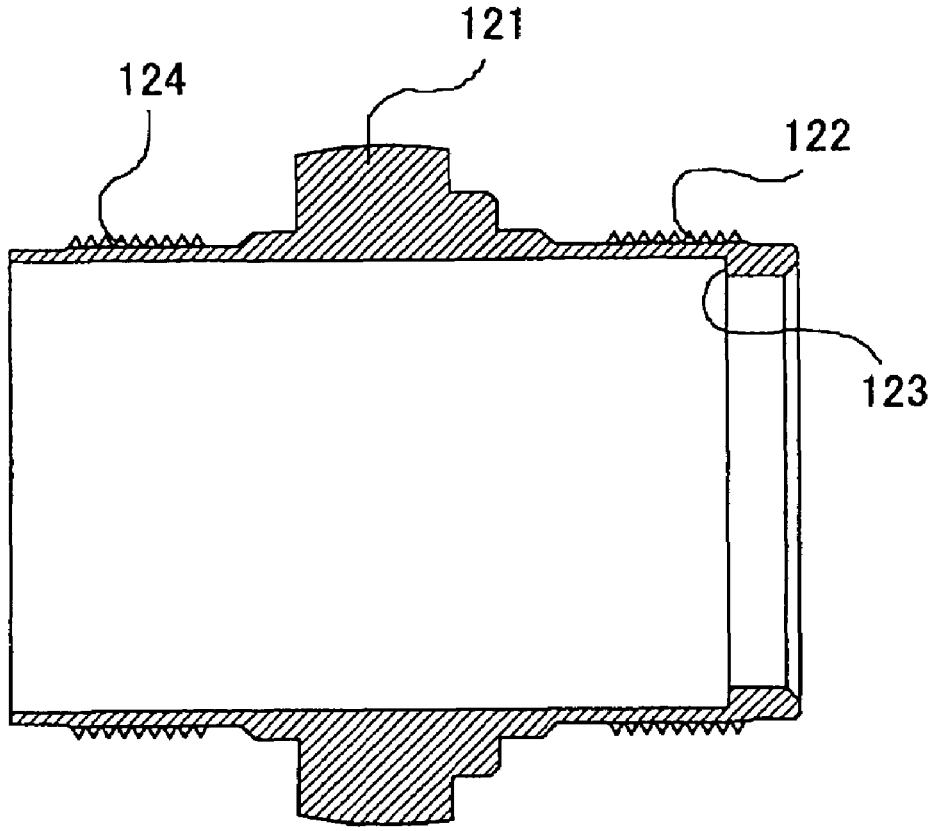
FIG. 12 is an outline cross-sectional view of a connecting screw.

FIG. 12 is the outline cross-sectional view of the connecting screw 8. As shown in the drawing, the connecting screw 8 is a cylindrical body having a flange shaped portion 121 of a larger diameter on nearly its center and open faces on both ends. The outer face of the flange shaped portion 112 together with the front outer cylinder 10 (which will be explained below) and the rear outer cylinder 2 forms an appearance of the writing instrument 1. The front side face of the flange shaped portion 112 is slidingly contacted to the rear end face of the front outer cylinder 10. And the rear side face of the flange shaped portion 112 is slidingly contacted to the front end face of the rear outer cylinder 2.

A screw groove 122 is formed around on a rear outer face of the connecting screw 8 so as to be screwed to the screw groove 115 formed around on the front inner face of the connecting element 9. By this arrangement, the connecting element 9 is detachably attached to the connecting screw 8. An inner cylinder holding portion 123 is formed on the rear inner face so as to be fitted to a rear end face of the inner cylinder 11 (which will be explained below). The inner face of the connecting screw 8 is slidingly contacted to the rear outer face of the inner cylinder 11.

A screw groove 124 is formed around on a front outer face of the connecting screw 8 so as to be screwed to a screw groove formed around a rear inner face of the front outer cylinder 10 (which will be explained below).

Figure 13A:
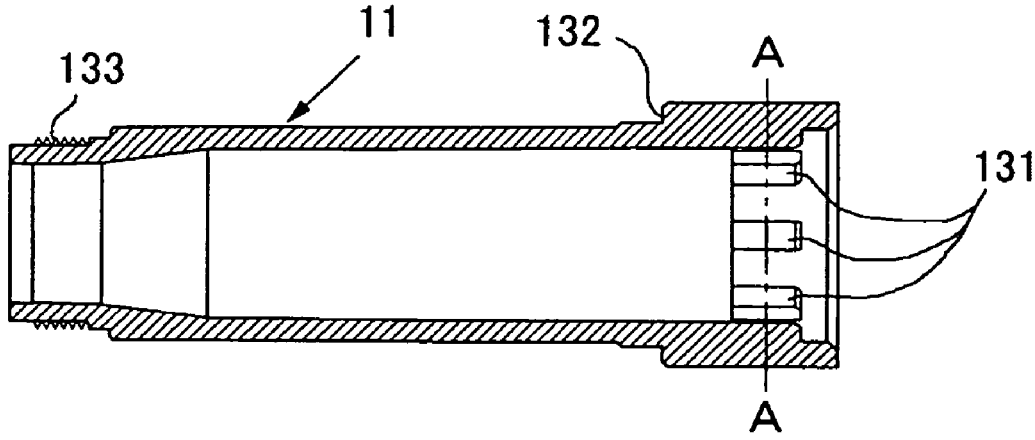
FIGS. 13A and 13B are views illustrating an inner cylinder.
Figure 13B:
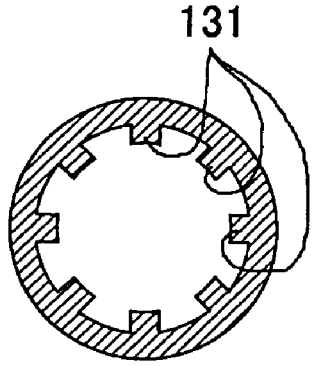

FIGS. 13A and 13B are views illustrating the inner cylinder 11. FIG. 13A is a cross-sectional view in the axial direction. FIG. 13B is a cross-sectional view cut along line A-A in FIG. 13A.

As shown in FIG. 13A, the inner cylinder 11 is a cylindrical body with open faces on both ends. The rear end face of the inner cylinder 11 is fitted to the inner cylinder holding portion 123 of the connecting screw 8. The rear end face is also fitted to the front end face of the mouthpiece sliding element 7. As clearly shown in FIG. 13B, convex strips 131 are formed on a rear inner face of the inner cylinder 11 at a predetermined pitch in the axial direction. The convex strips 131 slidably support the writing core element 13.

A spring holding seat 132 is formed on a rear outer face of the inner cylinder 11 so as to fit a rear end portion of a spring (which will be explained below) for returning the mouthpiece sliding element. The writing core element 13 is inserted through the inner cylinder 11. And the inner cylinder 11 is inserted thorough the front outer cylinder 10. A screw groove 133 is formed around on the front outer face of the inner cylinder 11 so as to be screwed to a screw groove formed on a rear inner face of the mouthpiece 12 (which will be explained below).

Figure 14:
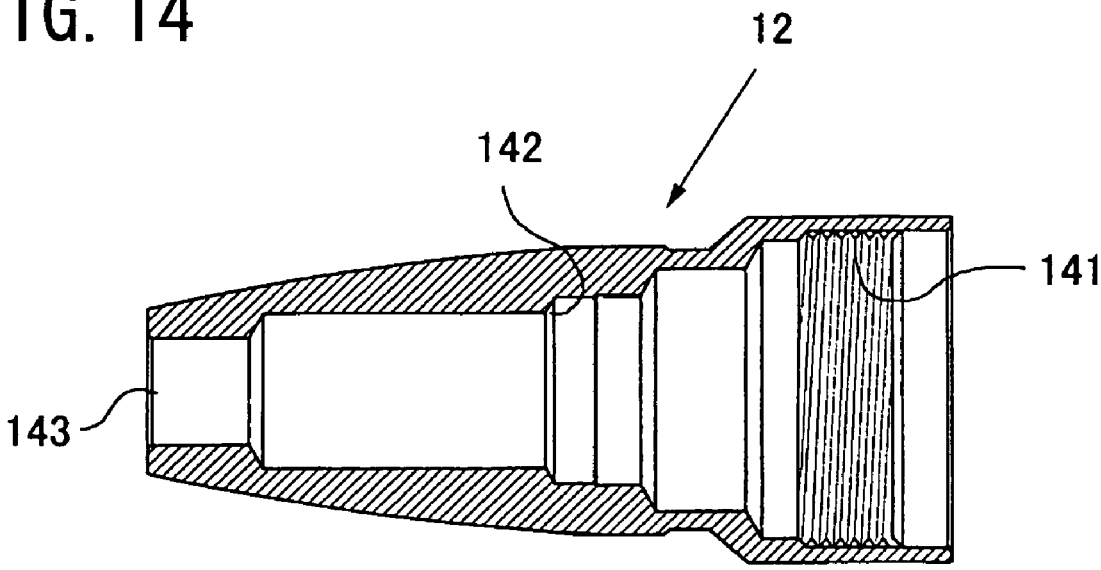
FIG. 14 is an outline cross-sectional view of the mouthpiece.

FIG. 14 is the outline cross-sectional view of the mouthpiece 12. As shown in FIG. 14, the mouthpiece 12 is a hollow conical body with open faces on both ends. A screw groove 141 is formed around on the rear inner face of the mouthpiece 12 so as to be screwed to the screw groove 133 formed around the front outer face of the inner cylinder 11 and the mouthpiece 12 is detachably connected to the inner cylinder 11.

A spring holding seat 142 is formed on a middle inner face of the inner cylinder 11 so as to fit to the front end portion of a spring (which will be explained below) for returning the refill sliding element 6. The writing core element 13 can be thrust out of an opening 143 of the mouthpiece 12.

Figure 15:
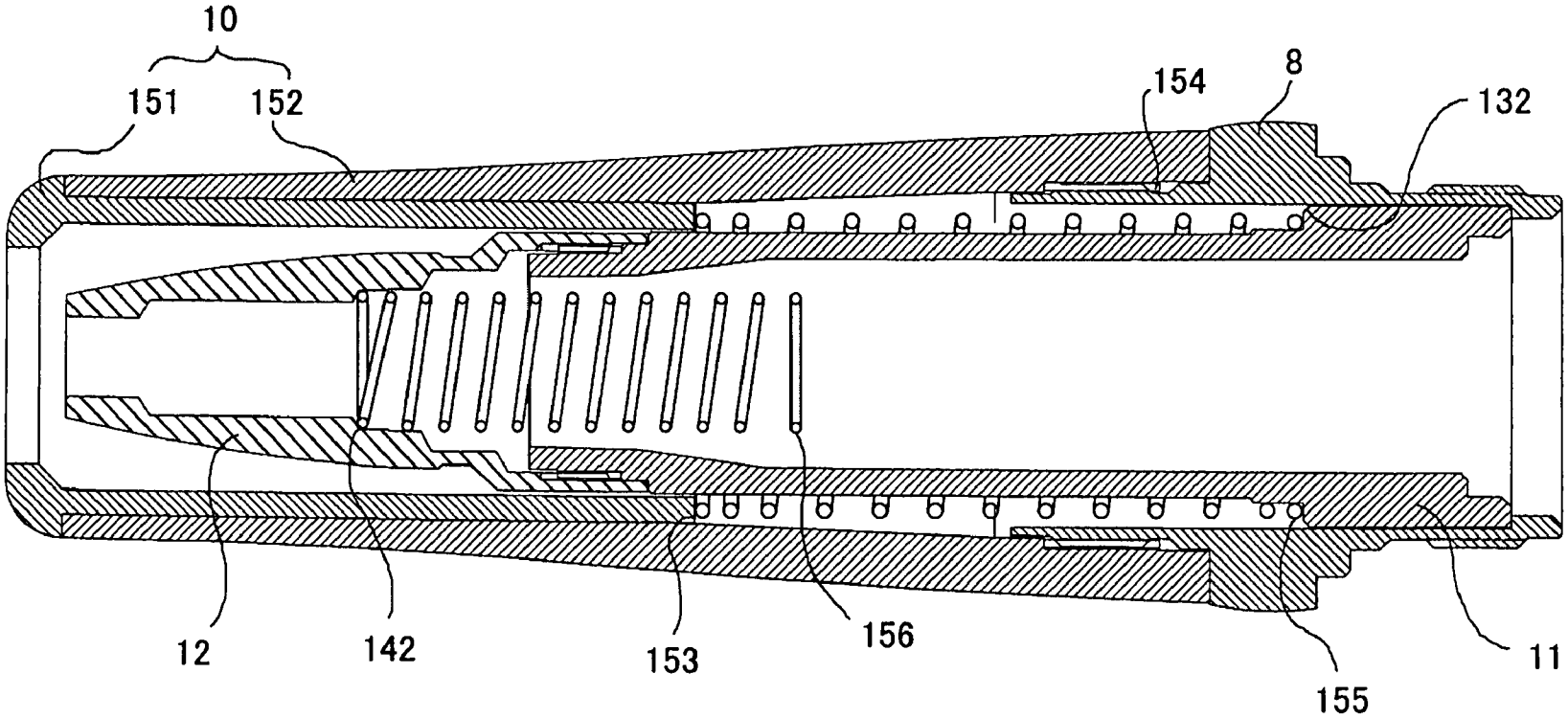
FIG. 15 is an outline cross-sectional view of a front portion of the writing instrument.

The front outer cylinder 10 is explained as referring to FIG. 15. FIG. 15 is the outline cross-sectional view of the front portion of the writing instrument 1. As shown in FIG. 15, the front outer cylinder 10 is a cylindrical body with open faces on both ends. The front outer cylinder 10 consists of a cylindrical front end 151 and a gripping member 152. A rear end face of the front cylinder 10 plays a role of a spring holding seat 153 for fitting a front end portion of a spring (which will be explained below) for returning the mouthpiece sliding element.

The inner cylinder 11 and the mouthpiece 12 are inserted thorough the cylindrical front end 151. The mouthpiece 12 and the writing core element 13 can be thrust out of an opening on the front end of the cylindrical front end 151.

A screw groove 154 is formed around on a rear inner face of the gripping member 152 for screwing to the screw groove 124 formed around on the front outer face of the connecting screw 8, so that the front outer cylinder 10 is detachably connected to the connecting screw 8. In a firmly connected state, the connecting screw 8 and the front outer cylinder 10 can not be moved relatively to each other, but in a loosened screwed state the connecting screw 8 and the front outer cylinder 10 is relatively rotatable relatively each other.

An inner face of the gripping member 152 is frictionally fitted to or abrasively fixed to an outer face of the cylindrical front end 151. The gripping member 152 can be formed out of various materials, for example, elastic materials such as rubber and the like, wood, metal or the like. In the present embodiment, the front outer cylinder 10 consists of the cylindrical front end 151 and the gripping member 152. However, it may be possible to integrate the cylindrical front end 151 and the gripping member 152 into a one-pieced front outer cylinder.

Hereinafter, the springs for returning the refill sliding element 6, the mouthpiece sliding element 7 and connecting screw 8 are explained as referring to FIG. 15. As shown in FIG. 15, a spring 155 for returning the mouthpiece sliding element is accommodated in an annular space formed between the inner face of the gripping member 152 of the front outer cylinder 10 and also the inner face of the connecting screw 8, and the outer face of the inner cylinder 11 such that the spring 155 extends from the spring holding seat 153 of the cylindrical front end 151 to the spring holding seat 132 of the inner cylinder 11.

A spring 156 for returning the refill sliding element is accommodated in an annular space formed between the inner face of the mouthpiece 12 and also the inner face of the inner cylinder 11, and an outer face of the writing core element 13 such that the spring 156 extends from the spring holding seat 142 of the mouthpiece 12 and a spring holding seat formed on an outer face of a cartridge of the writing core element 13 (which will be explained below).

In the present embodiment, coil springs are employed as the spring 155 for returning the mouthpiece sliding element and the spring 156 for returning the refill sliding element, but they are not limited to the coil springs. Other elastic members may be also employable.

Figure 16:
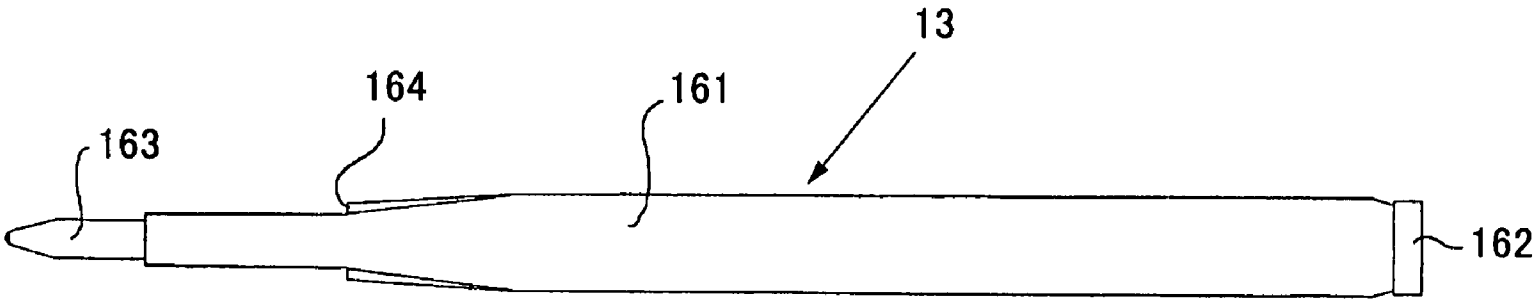
FIG. 16 is a front view of the writing core element.

FIG. 16 is the front view of the writing core element 13. In the drawing, the writing core element 13 is illustrated as a well-known ball point pen refill. The writing core element consists of a cartridge 161 with open faces on both ends for accommodating ink, an end plug 162 to be inserted and fitted in the rear end of the cartridge 161 and a tip member (a chip portion) 163 of the ball point pen. The rear outer face of the writing core element 13 is held in inner faces of the protrusions 82 for fitting of the refill sliding element 6, and the rear end face of the writing core element 13 is fitted to the front end face of the refill sliding element 6. A spring holding seat 164 is formed on a front outer face of the cartridge 161 of the writing core element 13 for fitting a rear end portion of the spring 156 for returning the refill sliding element.

In the present embodiment the ball point pen refill is explained as the writing core element, but it is not limited to the ball point pen refill. A well-known automatic pencil mechanism may be employed as the writing core element.

Hereinafter working steps of the writing instrument by the present invention are explained as referring to FIGS. 17A to 17C and FIG. 18.

Figures 17A, 17B, 17C:
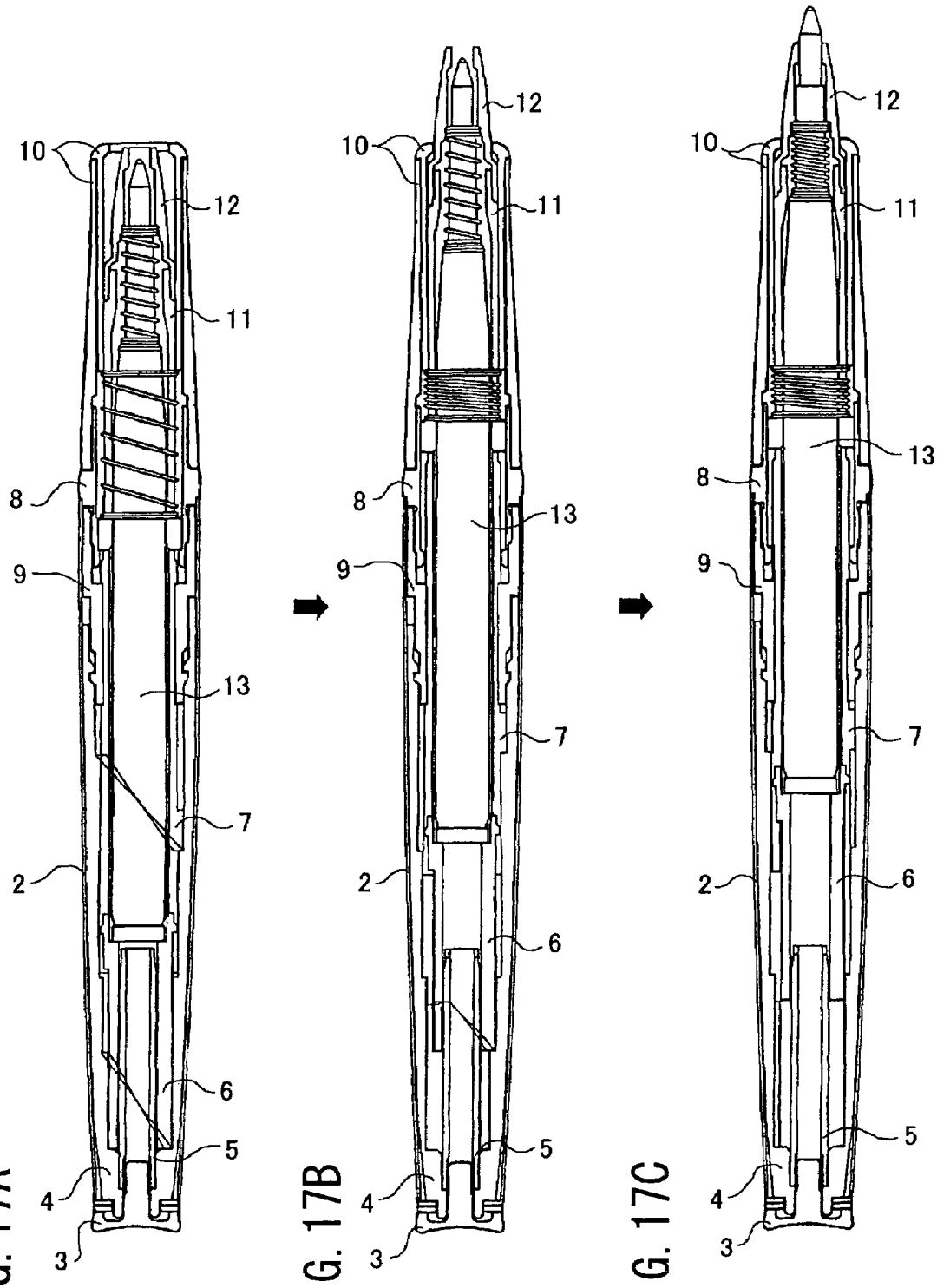
FIGS. 17A to 17C are views illustrating working steps of the writing instrument.
Figure 18:
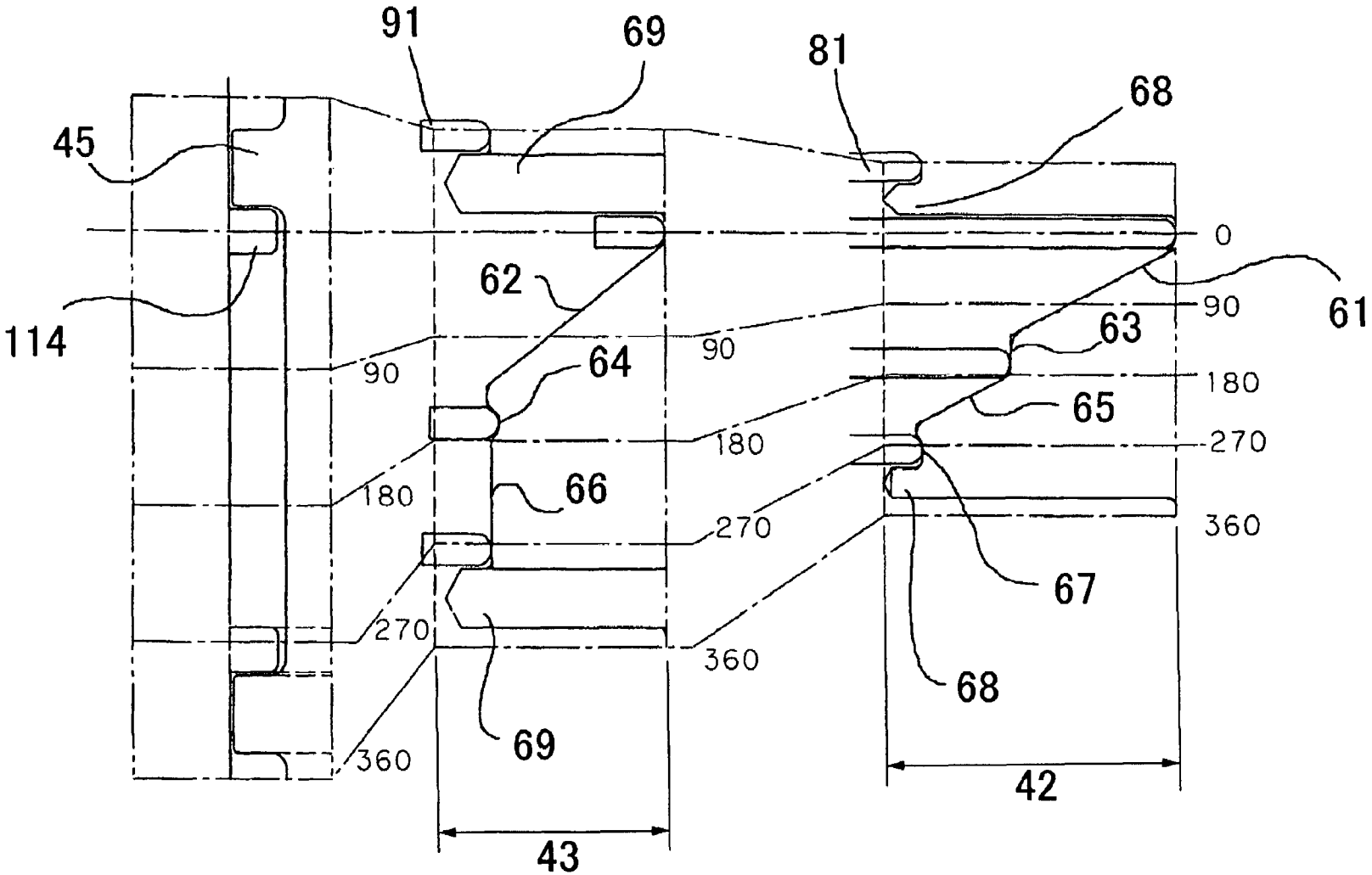
FIG. 18 is a view illustrating relations among the refill sliding cam, the mouthpiece sliding cam and a protrusion for restraining rotating range.

FIGS. 17A to 17C are the views illustrating working steps of the writing instrument 1. FIG. 18 is the developed views showing relations among the refill sliding cam 42, the mouthpiece sliding cam 43 and the protruded portion 45 for restraining rotating range of the inner sheath. When the writing instrument is not in use, the mouthpiece 12 is held at a position backward a little from the front opened face of the front outer cylinder 10 as shown in FIG. 17A. And the writing core element 13 is held at a position backward a little from the opening 143 of the mouthpiece 12.

In this state, the inner cylinder 11, the mouthpiece 12 connected to the inner cylinder 11 and the mouthpiece sliding element 7 are pressed backward by the spring 155 for returning the mouthpiece sliding element. And the writing core element 13 and the refill sliding element 6, to which the writing core element 13 is fitted, are pressed backward by the spring 156 for returning the refill sliding element.

When the rear outer cylinder 2 and the inner sheath 4 are rotated one turn in one direction relative to the front outer cylinder 10 and the connecting screw 8, the mouthpiece sliding element 7 is propelled forward against a backward pressure by the spring 155 for returning the mouthpiece sliding element.

As shown in FIG. 18, when the outer cylinder 2 and the inner sheath 4 are rotated one turn in one direction as keeping the mouthpiece 12 and the writing core element 13 in an accommodated state, during a half turn from 0 to 180° the first slope 61 of the refill sliding cam 42 and the protruded portion 81 for sliding of the refill sliding element 6 are fitted each other, so that the protruded portion 81 is slidingly moved forward as being pushed by the first slope 61. In the same way, the first slope 62 of the mouthpiece sliding cam 43 and the protruded portion 91 for sliding of the mouthpiece sliding element 7 are fitted each other, so that the protruded portion 91 is slidingly moved forward as being pushed by the first slope 62. At a turning position of 180° the protruded portion 91 for sliding of the mouthpiece sliding element 7 is fitted to the sliding member fitting recess 64.

Since the first slope 61 of the refill sliding cam 42 and the first slope 62 of the mouthpiece sliding cam 43 have nearly the same inclination and height, the refill sliding element 6 and mouthpiece sliding element 7 are slid forward by nearly the same distance. Therefore, a positional relation between the mouthpiece 12 and the writing core element 13 is virtually unchanged before and after they are slid. By these sliding movements the mouthpiece sliding element 7 and the refill sliding element 6 are moved to positions shown in FIG. 17B, so that the mouthpiece 12 and the writing core element 13 are thrust out of the front opening of the front outer cylinder 10.

When the outer cylinder 2 and the inner sheath 4 are rotated in the same direction further, only the refill sliding element 6 is propelled forward against the pressure by the spring 156 for returning the refill sliding element.

In other words, as shown in FIG. 18, when the outer cylinder 2 and the inner sheath 4 are rotated in the same direction as keeping the mouthpiece 12 and the writing core element 13 in a state being thrust out of the front opening of the front outer cylinder 10, during a partial turn from 180° to 270°, the second slope 65 of the refill sliding cam 42 and the protruded portion 81 for sliding of the refill sliding element 6 are fitted each other, so that the protruded portion 81 for sliding of the refill sliding element 6 is slidingly moved forward as being pushed by the second slope 65. At a position of 270° the protruded portion 81 for sliding of the refill sliding element 6 is fitted to the sliding member fitting recess 67. On the other hand, since the protruded portion 91 for sliding of the mouthpiece sliding element 7 and the perpendicular portion 66 of the mouthpiece sliding cam 43 are fitted together, the mouthpiece sliding element 7 is not slidingly moved forward.

In this way the chip portion 163 of the ball point pen of the writing core element 13 reached to a thrust position out of the front end opening 143 of the mouthpiece 12 as shown in FIG. 17C.

The refill sliding cam 42 and the mouthpiece sliding cam 43 respectively have the protrusions 68, 69 for restraining rotation, and these protrusions fit to the protruded portion 81 of the refill sliding element 6 and the protruded portion 91 of the mouthpiece sliding element 7 respectively, so that the rear outer cylinder 2 and the inner cylinder 4 cannot be rotated beyond 270°. Since the protrusion 45 for restraining rotating range of the inner sheath 4 fits to the rotating position restraining member 114 of the connecting element 9, further rotation beyond 270° of the rear outer cylinder 2 and the inner cylinder 4 are also restrained.

In order to accommodate the chip portion 163 of the ball pint pen of the writing core element 13 and the mouthpiece 12 into the main body of the writing instrument, the rear outer cylinder 2 and the inner sheath 4 are rotated in the reverse direction. In this way, pressures of the spring 155 for returning the mouthpiece sliding element and the spring 156 for returning the refill sliding element have the mouthpiece 12 and the writing core element 13 being accommodated into the main body of the writing instrument 1 by carrying out of the above-mentioned steps in the reverse order. The mouthpiece 12 and the writing core element 13 may be accommodated into the main body of the writing instrument by other mechanical ways than by pressures of the springs.

In order to exchange the writing core element 13, the connecting element 8 and the front outer cylinder 10 are separated from the rear outer cylinder 2 after the connecting screw 8 and connecting element 9 are unscrewed. In this state, the writing core element 13 can be pulled out of the rear outer cylinder 2 by pulling forward the writing core element 13 held in the rear outer cylinder 2.

Then a new writing core element 13 is inserted into the rear outer cylinder 2 and the rear end face of the writing core element 13 is fitted to the front end face of the refill sliding element 6. Then the connecting screw 8 and connecting element 9 are screwed together after the front outer cylinder 10 and the connecting screw 8 are fitted to the rear outer cylinder 2. By these successive steps the writing core element 13 is exchanged.

What is claimed is:

1. A rotating retractable writing instrument comprising:

a rear outer cylinder with an open front face;

an inner sheath unrotatably accommodated in said rear outer cylinder; and a front outer cylinder with open faces on both ends, wherein: a mouthpiece and a writing core element can be thrust out of an opening formed on the front face of said front outer cylinder, said writing instrument further comprising:

a protrusion for restraining rotating range arranged on a front end face of said inner sheath; and a refill sliding cam and a mouthpiece sliding cam formed on an inner face of said inner sheath, said writing instrument further comprising:

a refill sliding element and a mouthpiece sliding element accommodated in said inner sheath slidably in an axial direction and unmovably in a radial direction; and protruded portions for sliding formed respectively on outer faces of said refill sliding element and said mouthpiece sliding element; wherein: said protruded portions for sliding are respectively fitted to said refill sliding cam and said mouthpiece sliding cam; and said mouthpiece sliding element is slidably and unrotatably connected to said refill sliding element, said writing instrument further comprising:

a connecting element connected to said inner sheath rotatably and unmovably in the axial direction; and a rotating position restraining member arranged on an outer face of said connecting element for restraining a rotation of said inner sheath; wherein: said mouthpiece sliding element is slidably fitted to said connecting element, wherein:

when said rear outer cylinder is rotated in one direction relative to said connecting element, said inner sheath is rotated in the same direction together with said rear outer cylinder so that said mouthpiece and said writing core element are propelled forward and thrust out of said opening of said front outer cylinder; and when said rear outer cylinder is further rotated in the same direction, said writing core element is propelled forward and thrust out of an opening on the front face of said mouthpiece.

2. The writing instrument according to claim 1, wherein:

said writing instrument further comprises a connecting member;

a flange shaped portion with a large diameter is arranged in the middle of said connecting screw;

a rear end face of said flange shaped portion is slidingly fitted to the front face of said rear outer cylinder;

said front outer cylinder is detachably connected to said connecting member; and said connecting member is detachably connected to said connecting element.

3. The writing instrument according to claim 1, wherein:

in a first range starting from an arbitrary line in an axial direction on the inner face of said inner sheath, said refill sliding cam and said mouthpiece sliding cam respectively have first slopes;

in a second range succeeding to the first range, said refill sliding cam has a perpendicular portion and said mouthpiece sliding cam has a sliding element fitting recess;

in the next third range, said refill sliding cam has a second slope and said mouthpiece sliding cam has a perpendicular portion;

in the next fourth range, said refill sliding cam has a sliding element fitting recess; and in the next fifth range, said refill sliding cam and said mouthpiece sliding cam respectively have protrusions for restraining rotation.

4. The writing instrument according to claim 1, wherein:

a resistant member is arranged on an outer face of said connecting element such that said resistant member is slidingly contacted to said rear outer cylinder.

5. The writing instrument according to claim 4, wherein:

said resistant member is an O-ring.

* * * * *